US010553346B2

(12) United States Patent
Ryu

(10) Patent No.: US 10,553,346 B2
(45) Date of Patent: Feb. 4, 2020

(54) THIN FILM INDUCTOR AND METHOD OF MANUFACTURING THE SAME

(71) Applicant: SAMSUNG ELECTRO-MECHANICS CO., LTD., Suwon-si, Gyeonggi-do (KR)

(72) Inventor: Joung Gul Ryu, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/634,523

(22) Filed: Jun. 27, 2017

(65) Prior Publication Data

US 2018/0122554 A1 May 3, 2018

(30) Foreign Application Priority Data

Nov. 1, 2016 (KR) ..... 10-2016-0144644

(51) Int. Cl.
*H01F 27/24* (2006.01)
*H01F 27/28* (2006.01)
(Continued)

(52) U.S. Cl.
CPC ..... *H01F 27/2804* (2013.01); *H01F 27/24* (2013.01); *H01F 27/32* (2013.01);
(Continued)

(58) Field of Classification Search
CPC .. H01F 3/08; H01F 17/0013; H01F 2017/048; H01F 2017/0073;
(Continued)

(56) References Cited

U.S. PATENT DOCUMENTS 8,009,006 B2 * 8/2011 Ahn ..... H01F 17/0013 336/200
8,482,371 B2 7/2013 Jeong et al.
(Continued)

FOREIGN PATENT DOCUMENTS

CN 1574124 A 2/2005
CN 102760553 A 10/2012
(Continued)

OTHER PUBLICATIONS

Office Action issued in corresponding Korean Patent Application No. 10-2016-0144644, dated Aug. 14, 2017 (with full English Translation).
(Continued)

*Primary Examiner* — Mang Tin Bik Lian
(74) *Attorney, Agent, or Firm* — Morgan, Lewis & Bockius LLP

(57) ABSTRACT

A method of manufacturing a thin film inductor includes preparing a carrier film having a first surface on which a first upper separation layer is formed and a second surface on which a first lower separation layer is formed. A first upper layer, including a first upper coil pattern and a first upper insulating pattern, is formed on the first surface. A first lower layer, including a first lower coil pattern and a first lower insulating pattern, is formed on the second surface. A surface of the first upper layer is ground. A height of the first lower coil pattern is smaller than that of the first lower insulating pattern.

15 Claims, 10 Drawing Sheets

(51) Int. Cl.
*H01F 27/32* (2006.01)
*H01F 41/02* (2006.01)
*H01F 41/04* (2006.01)

(52) U.S. Cl.
CPC ..... *H01F 41/024* (2013.01); *H01F 41/042* (2013.01); *H01F 2027/2809* (2013.01)

(58) Field of Classification Search
CPC ..... H01F 27/2804; H01F 27/24; H01F 27/32; H01F 27/292; H01F 2027/2809; H01F 41/042; H01F 41/024; H01F 41/043; H01F 41/046
USPC ..... 336/233, 223, 200; 29/602.1, 605, 606
See application file for complete search history.

(56) References Cited

U.S. PATENT DOCUMENTS

| | | | | |
|---|---|---|---|---|
| 9,520,223 | B2 | 12/2016 | Yoo et al. | |
| 9,892,844 | B2 | 2/2018 | Park et al. | |
| 2004/0246088 | A1 | 12/2004 | Shoji et al. | |
| 2012/0274432 | A1* | 11/2012 | Jeong | H01F 27/2804 336/192 |
| 2013/0222101 | A1 | 8/2013 | Ito et al. | |
| 2014/0009254 | A1* | 1/2014 | Ohkubo | H01F 27/2804 336/192 |
| 2014/0184374 | A1* | 7/2014 | Park | H01F 27/255 336/83 |
| 2014/0285305 | A1* | 9/2014 | Yoo | H01F 27/2804 336/200 |
| 2015/0048918 | A1* | 2/2015 | Park | H01F 17/0013 336/200 |
| 2015/0270053 | A1 | 9/2015 | Cha et al. | |
| 2016/0086721 | A1 | 3/2016 | Park et al. | |
| 2016/0155556 | A1* | 6/2016 | Ohkubo | H01F 41/043 336/83 |

FOREIGN PATENT DOCUMENTS

| | | | |
|---|---|---|---|
| CN | 104078221 | A | 10/2014 |
| CN | 105448491 | A | 3/2016 |
| EP | 0 701 262 | A1 | 3/1996 |
| KR | 10-0231356 | B1 | 11/1999 |
| KR | 10-1434351 | B1 | 8/2014 |
| KR | 10-2015-0019588 | A | 2/2015 |
| KR | 10-1532171 | B1 | 7/2015 |
| KR | 10-1548862 | B1 | 8/2015 |
| KR | 10-2015-0108518 | A | 9/2015 |
| KR | 10-2016-0035819 | A | 4/2016 |
| KR | 10-2016-0065006 | A | 6/2016 |

OTHER PUBLICATIONS

Office Action issued in corresponding Chinese Application No. 201710733812.0, dated Jul. 31, 2019.

* cited by examiner

THIN FILM INDUCTOR AND METHOD OF MANUFACTURING THE SAME

CROSS-REFERENCE TO RELATED APPLICATION(S)

This application claims benefit of priority to Korean Patent Application No. 10-2016-0144644 filed on Nov. 1, 2016 in the Korean Intellectual Property Office, the disclosure of which is incorporated herein by reference in its entirety.

BACKGROUND

1. Field

The present disclosure relates to a thin film inductor and a method of manufacturing the same.

2. Description of Related Art

An inductor element is an important passive element in electronic circuits and is mainly used in power supply circuits, such as Direct Current (DC)-DC converters in electronic devices, or as a component for removing noise or configuring an LC resonance circuit. The use of power inductors for decreasing current loss and increasing efficiency has increased in accordance with demand for multi-driving of communications, a camera, a game, or the like in a smart phone, a tablet PC, or the like.

An inductor element may, for example, a multilayer type inductor, a wire-wound type inductor, a thin film type inductor, and the like, depending on its structure. As miniaturization and thinning of electronic devices has accelerated, a thin film inductor element has widely been used.

Thin film inductor technologies have required a coil having an aspect ratio of 5:1 or more. In order to achieve thinness while including a coil having a high aspect ratio, the support member on which the coil is formed should be thinned.

SUMMARY

An aspect of the present disclosure may provide a thin film inductor including a support member having a thickness of 40 m or less using a carrier film, and a method of manufacturing the same.

An aspect of the present disclosure may also provide a method of manufacturing a thin film inductor capable of improving quality at the time of performing grinding work by forming a first upper layer and a first lower layer on first and second opposing surfaces of a carrier film so that a first lower insulating pattern formed on the first lower layer is formed to have a height greater than that of a first lower coil pattern.

According to an aspect of the present disclosure, a method of manufacturing a thin film inductor may include: preparing a carrier film having a first surface on which a first upper separation layer is formed and a second surface on which a lower separation layer is formed. A first upper layer, including a first upper coil pattern and a first upper insulating pattern, is formed on the first surface and a first lower layer, including a first lower coil pattern and a first lower insulating pattern, is formed on the second surface. A surface of the first upper layer is ground. The height of the first lower coil pattern is smaller than that of the first lower insulating pattern.

According to another aspect of the present disclosure, a thin film inductor may include an insulating part including a support member and having a central portion including a core formed of a magnetic material. First and second coil patterns are in the insulating part and electrically connected to each other by a via penetrating through the support member, with the support member interposed therebetween. Upper and lower cover parts formed of a magnetic material and on upper and lower portions of the insulating part, respectively. The first coil pattern contains conductive particles and a binder, and the second coil pattern is a plating layer.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Method of Manufacturing Thin Film Inductor

Figure 1:
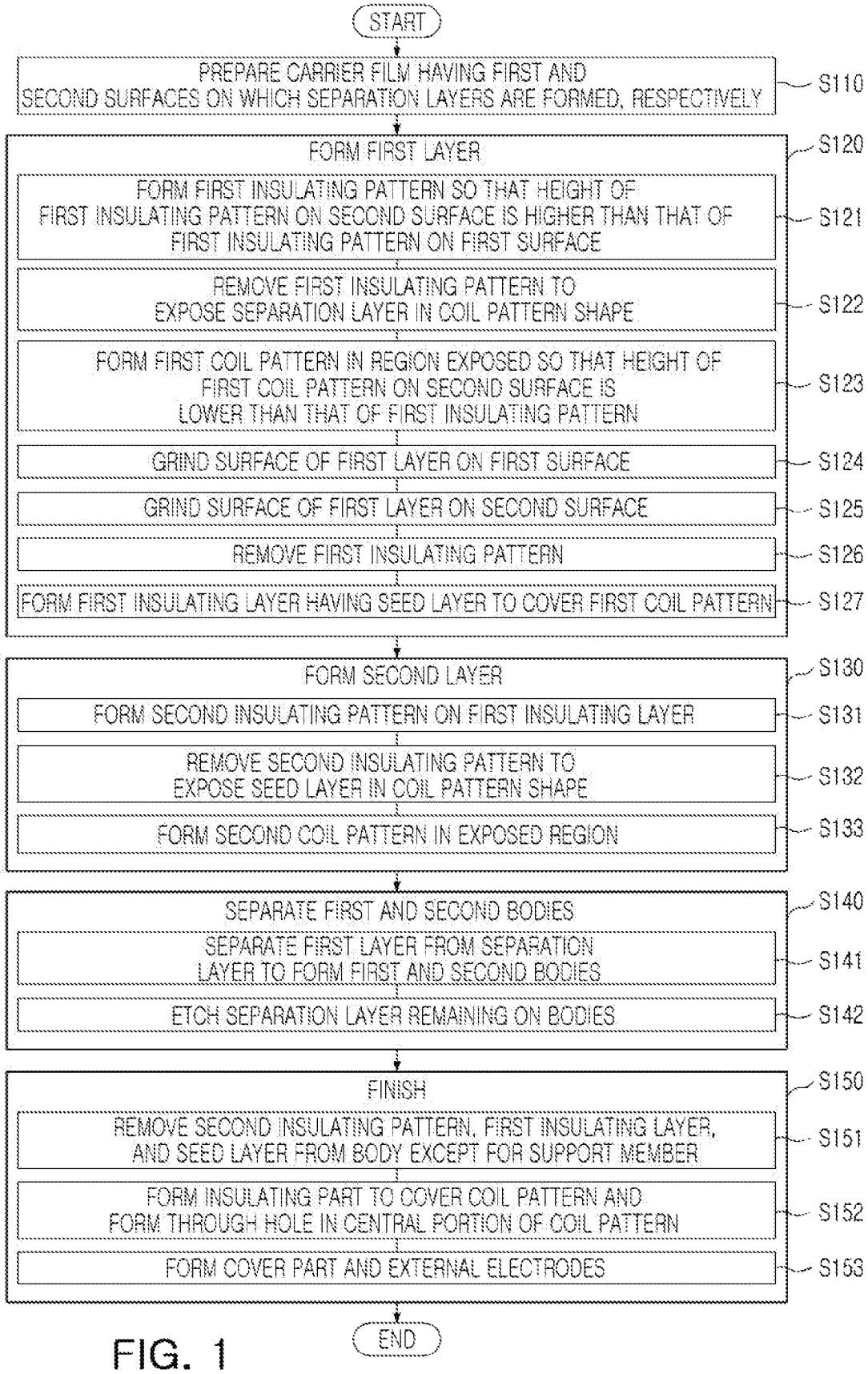
FIG. 1 is a flowchart schematically illustrating a method of manufacturing a thin film inductor according to an exemplary embodiment in the present disclosure.

FIG. 1 is a flow chart schematically illustrating a method of manufacturing a thin film inductor according to an exemplary embodiment in the present disclosure.

Referring to FIG. 1, the method of manufacturing a thin film inductor according to the exemplary embodiment in the present disclosure may include the following steps. In step S110, a carrier film having first and second opposing surfaces and on which separation layers are formed, is prepared. In step S120, a first layer, including a first coil pattern and a first insulating pattern, is formed on both surfaces of the carrier film. In step S130, a second layer, including a second coil pattern and a second insulating pattern, is formed on the first layer. In step S140, first and second bodies are separated from the carrier film. In a finishing step S150, a core and external electrodes are formed.

Figure 2:
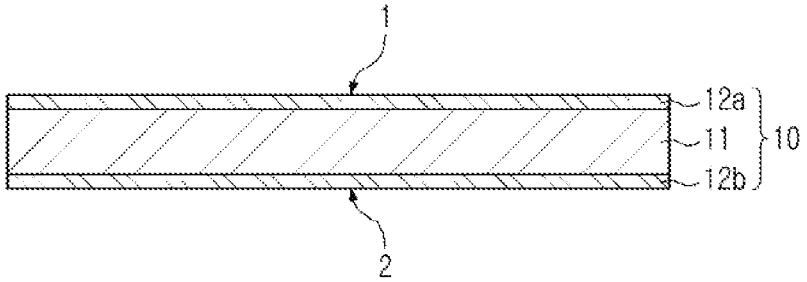
FIGS. 2 through 15 are cross-sectional views schematically illustrating the method of manufacturing a thin film inductor according to the exemplary embodiment in the present disclosure.

The method of fabricating a thin film inductor according to the exemplary embodiment in the present disclosure may be undertaken using a carrier film illustrated in FIG. 2. The carrier film used in the method of fabrication a thin film inductor according to the exemplary embodiment in the present disclosure will be described with reference to FIG. 2.

Referring to FIG. 2, a carrier film 10 may have first and second surfaces 1 and 2 and include a substrate layer 11 and first separation layers 12*a* and 12*b* respectively disposed on both surfaces of the substrate layer 11.

The separation layers 12*a* and 12*b* may adhere to both surfaces of the substrate layer 11 via an adhesive layer.

The substrate layer 11 may comprise paper, non-woven fabric, or synthetic resins such as polyethylene, polypropylene, polybutylene, and the like.

The separation layers 12*a* and 12*b* may be formed of a conductive metal. For example, the separation layers 12*a* and 12*b* may be formed of any one selected from the group consisting of copper (Cu), gold (Au), silver (Ag), nickel (Ni), palladium (Pd), and platinum (Pt), or an alloy thereof, but are not limited thereto.

The thickness of the substrate layer 11 may be about 18 μm.

Preferably, the separation layers 12*a* and 12*b* may have a thickness of about 12 μm at which a tenting method may be performed. However, the separation layers 12*a* and 12*b* may be formed to have a thickness of 1.5 to 12 μm depending on the method of forming an epoxy partition.

The carrier film 10 may be divided into two parts when separating the first and second bodies (S140) described above, such that the separation layers 12*a* and 12*b* may be separated from the substrate layer 11.

The adhesion force of the adhesive layer may be deteriorated by a predetermined factor, for example, heat or ultraviolet (UV) light.

Separating the first and second bodies (S140) may be performed using UV light, where an adhesive generating gas is used at the time of irradiating UV light on the adhesive layer. The adhesion force may deteriorate by irradiating UV light when separating the separation layers 12*a* and 12*b* to generate gas in the adhesive layer and change the volume of the adhesive layer.

The first and second bodies may be separated (S140) using heat, when using a foamable adhesive. When separating the separation layers 12*a* and 12*b*, foam is generated in the adhesive layer by applying heat thereto, such that unevenness is formed on an adhesive surface, and the adhesion properties may deteriorate.

The separation layers 12*a* and 12*b* may be separated from the substrate layer 11 by the above-mentioned method when separating the first and second bodies in step S140.

When the carrier film 10 is used, two bodies 100*a* and 100*b* may be formed through a single process by forming a first layer, including a first coil pattern and a first insulating layer, on the front surface 1 of the carrier film 10, forming a second layer, including a second coil pattern and a second insulating layer, on the second surface 2 of the carrier film 10, and then separating.

As described above, since the method of manufacturing a thin film inductor according to the exemplary embodiment uses the carrier film 10 including the separation layers 12*a* and 12*b*, two bodies may be manufactured through the single process. As such, the method of manufacturing a thin film inductor according to the exemplary embodiment may enable mass production by simplifying a manufacturing process.

After preparing the carrier film 10 (S110), the first layer may be formed (S120).

FIGS. 3 through 6 are views illustrating processes for forming the first layer (S120).

Figure 3:
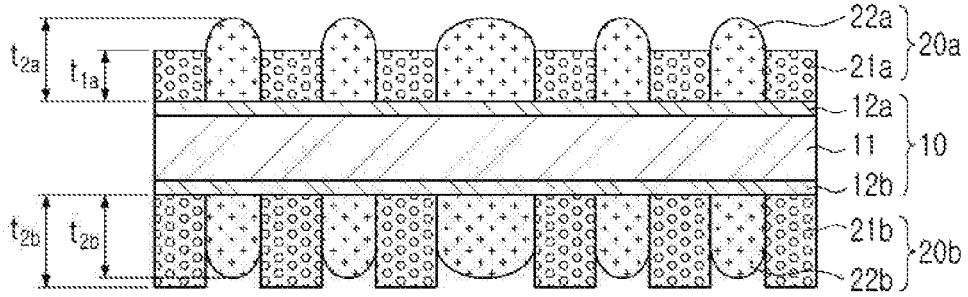

Referring to FIG. 3, a first layer 20*a*, including a first coil pattern 22*a* and a first insulating pattern 21*a*, may be formed on the first surface 1, and a first layer 20*b*, including a first coil pattern 22*b* and a first insulating pattern 21*b*, may be formed on the second surface 2.

Each process will be described in detail. First, the first insulating patterns 21*a* and 21*b* may be formed (S121) so that the first insulating pattern 21*b* on the second surface 2 has a height greater than that of the first insulating pattern 21*a* on the first surface 1.

That is, the first insulating patterns 21*a* and 21*b* (S121) may be formed so that a height $t_{1a}$ of the first insulating pattern 21*a* is smaller than a height $t_{1b}$ of the first insulating pattern 21*b*.

The ratio of $t_{1b}$ to $t_{1a}$ may be 1.1 to 5.

Under the condition that the height $t_{1a}$ of the first insulating pattern 21*a* is smaller than the height $t_{1b}$ of the first insulating pattern 21*b*, $t_{1a}$ may be 25 to 175 μm, and $t_{1b}$ may be 50 to 200 μm, but $t_{1a}$ and $t_{1b}$ are not limited thereto.

The first insulating patterns 21*a* and 21*b* may be formed of a photoresist, for example, a dry film resist (DFR), but are not limited thereto.

Next, the first separation layers 12*a* and 12*b* may be exposed to the first insulating patterns 21*a* and 21*b* so as to have a coil pattern shape (S122). When the first insulating patterns 21*a* and 21*b* are formed of the photoresist, the first separation layers 12*a* and 12*b* may be exposed to the first insulating patterns 21*a* and 21*b* so as to have a coil pattern shape by exposing, developing, and removing the photoresist in the coil pattern shape.

The first coil patterns 22*a* and 22*b* may be formed in portions of the first insulating patterns 21*a* and 21*b* removed in the coil pattern shape, respectively (S123).

The first coil patterns 22*a* and 22*b* may be formed using a conductive paste.

The conductive paste may contain conductive particles and a binder, wherein the conductive particles may be formed of any one selected from the group consisting of copper (Cu), silver (Ag), gold (Au), aluminum (Al), and nickel (Ni), or a mixture thereof. However, the conductive paste is not limited thereto.

The first coil patterns 22*a* and 22*b* may be formed to have an aspect ratio of about 1:1. Since heights of first coil patterns 22*a* and 22*b* are adjusted by grinding as described below, the first coil patterns 22*a* and 22*b* may be formed to be slightly thicker than the target height.

The height $t_{2a}$ of the first coil patterns 22*a* may be similar to the height $t_{2b}$ of the first coil pattern 22*b*, but is not limited thereto.

The height $t_{2b}$ of the first coil pattern 22*b* may be smaller than the height $t_{1b}$ of the first insulating pattern 22*b*. As described above, since the height $t_{1a}$ of the first insulating pattern 21*a* is smaller than the height $t_{1b}$ of the first insulating pattern 21*b*, when the heights of the first coil patterns 22*a* and 22*b* are similar to each other, the height $t_{2b}$ of the first coil pattern 22*b* may be smaller than the height $t_{1b}$ of the first insulating pattern 22*b* and the height $t_{2a}$ of the first coil pattern 22*a* may be larger than the height $t_{1a}$ of the first insulating pattern 21*a*.

Figure 4:
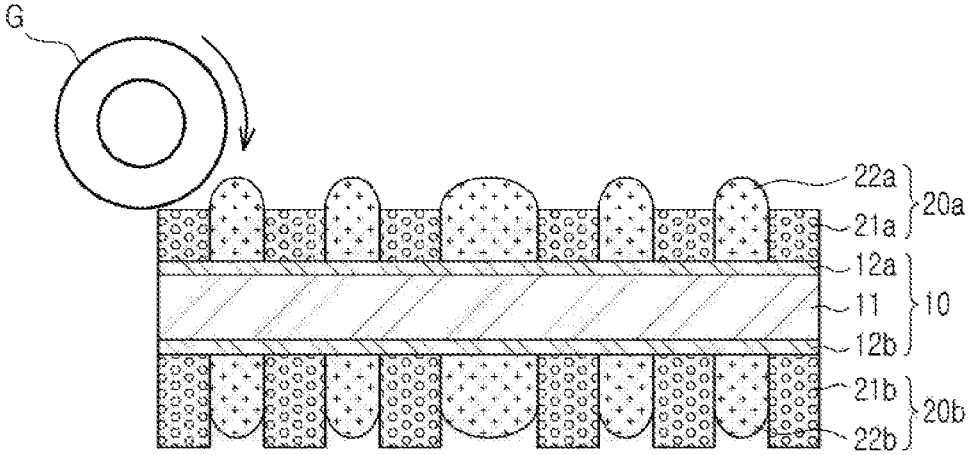

As illustrated in FIG. 4, the surface of the first layer may be ground (S124).

In the method of manufacturing a thin film inductor according to the exemplary embodiment in the present disclosure, since the height $t_{2b}$ of the first coil pattern 22*b* is smaller than the height $t_{1b}$ of the first insulating pattern 21*b*, when grinding the first layer (S124), the first insulating pattern 21*b* may be stably fixed to a bottom, to improve the grinding quality of the surface of the first layer.

The grinding of the first layer 20*a* (S124) may be performed using a grinder G, but is not limited thereto.

After the surface of the first layer 20*a* is ground, the surface of the first layer 20*b* may be ground (S125). Since the surface of the first layer 20*a* was ground, the grinding quality of the surface of the first layer 20*b* may also be improved.

After the grinding is performed, the first insulating patterns may be removed (S126). The removing of the first insulating patterns (S126) may be performed by a suitable method depending on a material used in the first insulating patterns.

Figure 5:
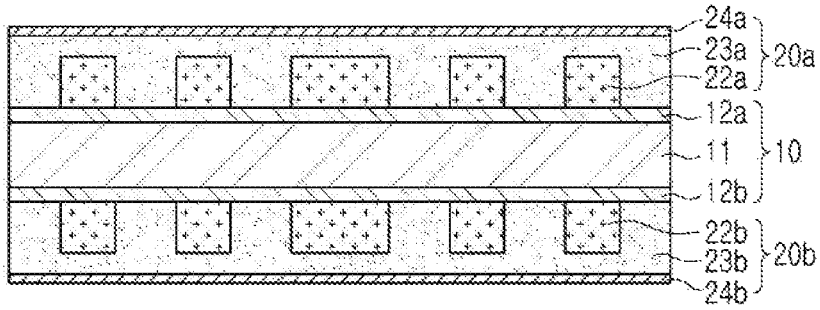

Referring to FIG. 5, after removing the first insulating patterns 21*a* and 21*b*, first insulating layers 23*a* and 23*b* may be formed to cover the remaining first coil patterns 22*a* and 22*b*.

First seed layers 24*a* and 24*b* may be disposed on the first insulating layers 23*a* and 23*b*, respectively.

First insulating layers 23*a* and 23*b* may be resin layers or build-up films on which seed layers are disposed, respectively, but are not limited thereto.

The thickness of the first seed layers 24*a* and 24*b* may be 1.5 to 5 μm, and preferably is 2 μm.

Portions of the first insulating layers 23*a* and 23*b* positioned on the first coil patterns 22*a* and 22*b* may have a minimum thickness that is enough to insulate second coil patterns, which will be described below, from the first coil patterns 22*a* and 22*b*. For example, the portions of the first insulating layers 23*a* and 23*b* positioned on the first coil patterns 22*a* and 22*b* may have a thickness of 5 to 40 μm corresponding to a thickness at which insulation breakdown does not occur.

The resin layer on which the seed layer is disposed may be a resin coated copper (RCC) layer. When the first insulating layers 23*a* and 23*b* are RCC layers, the seed layers may be formed thereon by a V-press or vacuum lamination method. In contrast, when the first insulating layers 23*a* and 23*b* are build-up films, after the films are applied, there is a need to additionally form seed layers 24*a* and 24*b* using a chemical copper process.

Figure 6:
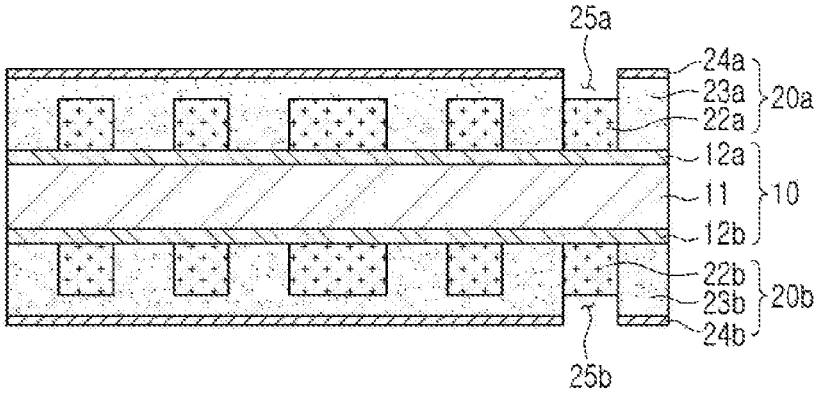

Referring to FIG. 6, first vias 25*a* and 25*b* for connection between upper and lower coil patterns may be formed in the first seed layers 24*a* and 24*b* and the first insulating layers 23*a* and 23*b*.

The first vias 25*a* and 25*b* may be formed by performing a desmearing process after $CO_2$ processing. It is preferable that the desmearing process after $CO_2$ processing is performed using a wet-type desmearing process, but the desmearing process not limited thereto, and a dry-type desmearing process may be performed.

When the insulating pattern of the second layer is an epoxy partition, close adhesion force of the surface on which the epoxy partition is disposed with the epoxy partition may be improved by plasma pre-treatment after the desmearing process.

After forming of the first layer (S120), the second layer may be formed (S130). The second layer may be formed by forming a second layer 30*a*, including a second coil pattern 32*a* and a second insulating pattern 31*a*, on the first layer 20*a* and forming a second layer 30*b*, including a second coil pattern 32*b* and a second insulating pattern 31*b*, on the first layer 20*b*.

Figure 7:
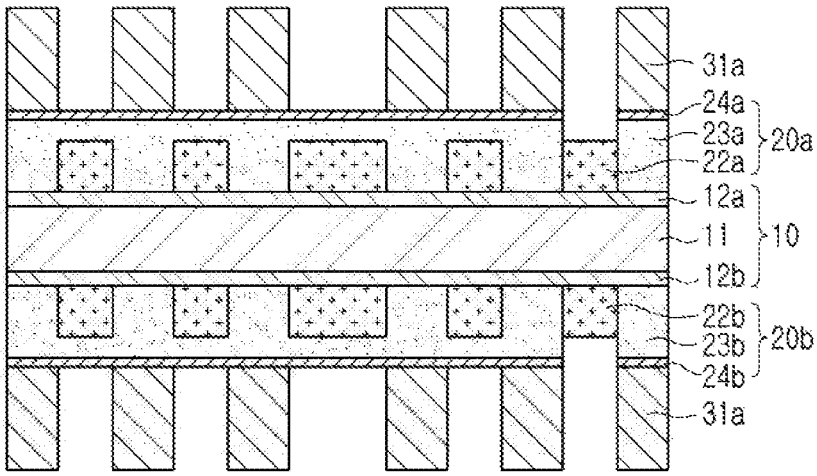
Figure 8:
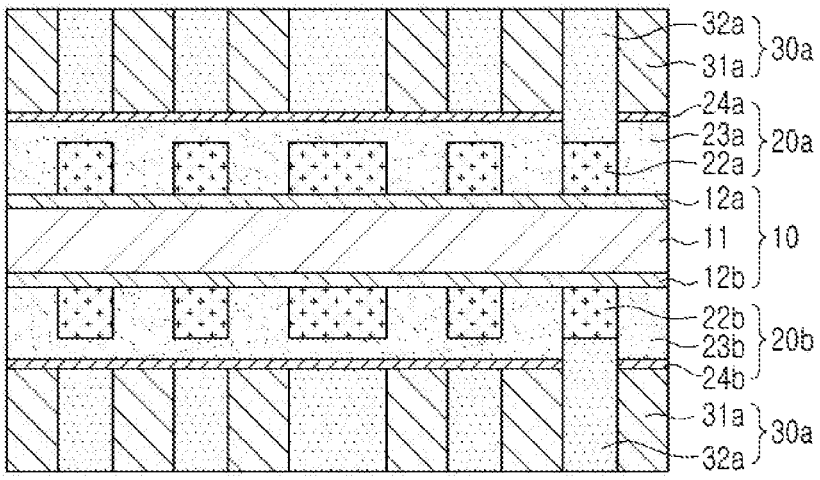

FIGS. 7 and 8 illustrates processes for forming the second layer (S130) according to the exemplary embodiment in the present disclosure, and are views that illustrate a method using the epoxy partition.

Hereinafter, forming the second layer (S130) will be described in detail with reference to FIGS. 7 and 8.

Referring to FIG. 7, the second insulating patterns 31*a* and 31*b* may be formed on the first insulating layers 23*a* and 23*b*, respectively (S131). The seed layers 24*a* and 24*b* may be exposed in a coil pattern shape by partially removing the second insulating patterns 31*a* and 31*b*, respectively (S132).

The second insulating patterns 31*a* and 31*b* may be epoxy partitions.

The epoxy partition used in the method of manufacturing a thin film inductor according to the exemplary embodiment in the present disclosure may be formed by applying an epoxy film, which is a chemical amplification photoresist capable of forming a fine pattern, by a vacuum lamination method, and then, exposing, developing, and drying the epoxy film.

The epoxy partition may be formed to have a height and an interval at which second coil patterns, which will be described below, have an aspect ratio of 5:1 or more. For example, the epoxy partition may be formed to have a height and an interval at which the second coil patterns will have an aspect ratio of 5:1 to 20:1.

Referring to FIG. 8, the second coil patterns 32*a* and 32*b* may be formed between the second insulating patterns 31*a* and 31*b*, respectively (S133).

The second coil patterns 32*a* and 32*b* may be formed (S133) using a plating method.

The second coil patterns 32*a* and 32*b* may have an aspect ratio of 5:1 to 20:1.

The second coil patterns 32*a* and 32*b* may be formed by plating copper (Cu) on the seed layers 24*a* and 24*b*.

After forming the second layer (S130), first and second bodies may be separated (S140). When separating the first and second bodies (S140), a first body 100*a* may be formed by separating the first layer 20*a* from the first separation layer 12*a* and a second body 100*b* may be formed by separating the first layer 20*b* from the first separation layer 12*b* (S141). The first separation layers 12*a* and 12*b* remaining on the first and second bodies 100*a* and 100*b* may be etched (S142).

Figure 9:
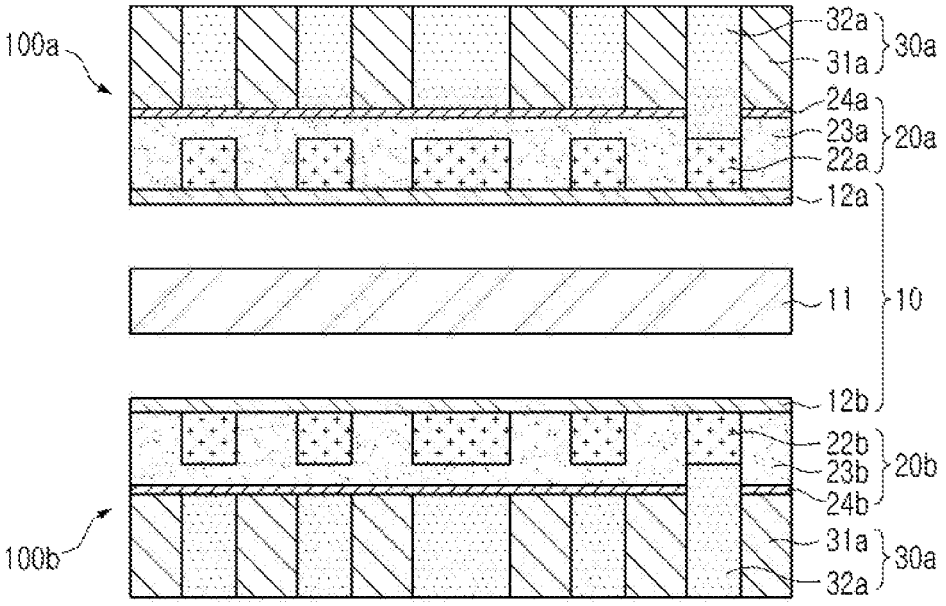
Figure 10:
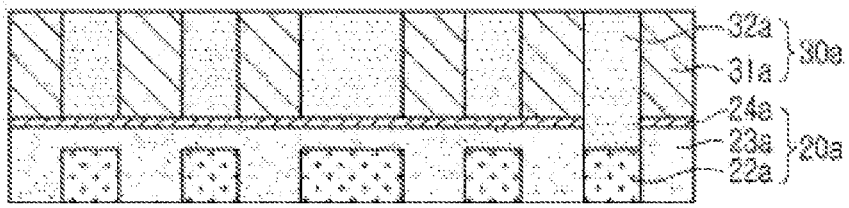

Referring to FIGS. 9 and 10, the first body 100*a* may be formed by separating the first layer 20*a* from the first separation layer 12*a* and the second body 100*b* may be formed by separating the first layer 20*b* from the first separation layer 12*b*.

The separation as described above may be performed using a detaching apparatus.

Since the first separation layers 12*a* and 12*b* may remain on the separated first and second bodies 100*a* and 100*b*, the remaining first separation layers 12*a* and 12*b* may be removed by etching.

Therefore, etched surfaces may be present on end portions of the first coil patterns 22*a* and 22*b*.

After separating the first and second bodies (S140), the finishing step (S150) may be performed.

The finishing step (S150) will be described in relation to the first body 100*a*, but is also applicable to the second body 100*b*.

The finishing step (S150) may include the following. In step S151, a portion of the first insulating layer 23*a* and the second insulating pattern 31*a* is removed. In step S152, an insulating part around the first coil pattern and the second coil pattern may be formed using a build-up film and a through hole may be formed in central portions of the first coil pattern and the second coil pattern. In step s153, upper and lower cover parts may be formed by compressing magnetic sheets on upper and lower portions of the first body, and external electrodes may be formed.

FIGS. 10 through 15 illustrate processes of the finishing step (S150).

Hereinafter, the finishing step (S150) will be described in detail with reference to FIGS. 10 through 15.

FIG. 10 shows the first insulating layer 23*a*, the first seed layer 24*a*, and the second insulating pattern 31*a* remaining in the separated body 100*a*.

Figure 11:
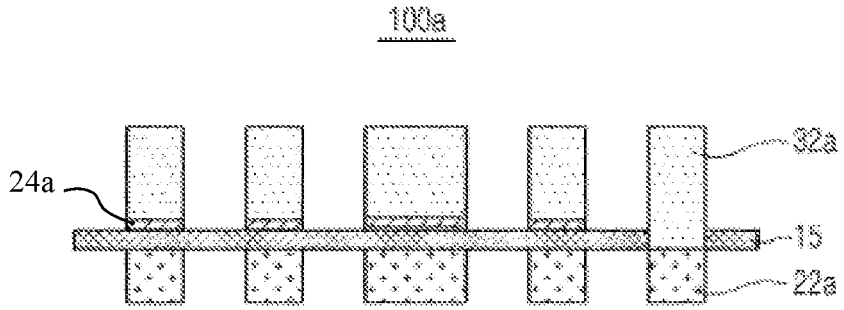

As illustrated in FIG. 11, except for a support member 15 as a portion of the first insulating layer 23*a* on a level between the seed layer 24*a* and the first coil pattern 22*a* and except for portions of the seed layer 24*a* on which the second coil pattern 32*a* is formed, the remaining portions of the first insulating layer 23*a*, the first seed layer 24*a*, and the second insulating pattern 31*a* may be removed using a $CO_2$ laser, or the like. Particularly, portions of the first seed layer 24*a* between the second insulating pattern 31*a* and the first insulating layer 23*a* may be removed by etching.

The support member 15 may have a thickness of 40 μm or less.

Figure 12:
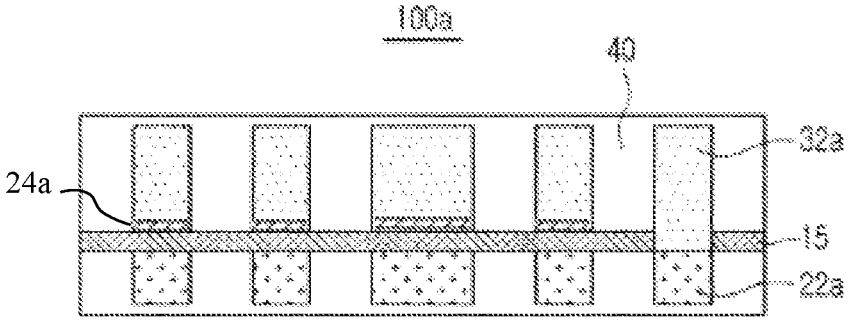

As illustrated in FIG. 12, an insulation part 40 may be formed to enclose the support member 15, the first coil pattern 22*a* disposed on a surface of the support member 15, and the second coil pattern 32*a* disposed on an opposing surface of the support member 15.

According to the related art, an insulating part was formed by a chemical vapor deposition method (CVD) using phenylene. But in the method of manufacturing a thin film inductor according to the exemplary embodiment in the present disclosure, the insulating part 40 may be formed by vacuum-laminating a build-up film such as an Ajinomoto build-up film (ABF). When forming the insulating part 40 using the build-up film, close adhesion with a coil and close adhesion with the cover part formed of a magnetic material may be improved as compared to the CVD method using phenylene.

Figure 13:
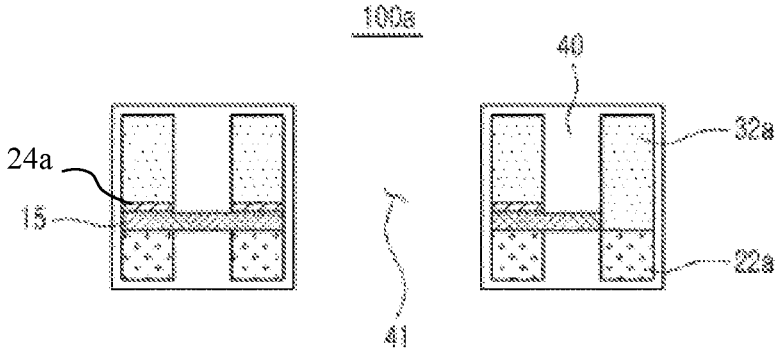

Referring to FIG. 13, after forming the insulating part 40, the through hole 41 may be formed in the central portions of the first coil pattern 22*a* and the second coil pattern 32*a*. When forming the through hole 41, the insulating part 40 around the first coil pattern 22*a* and the second coil pattern 32*a* may also be partially removed.

The through hole 41 may be formed using a $CO_2$ laser, or the like. Close adhesion with a core and a cover part, to be formed later using a magnetic material, may be improved by allowing the insulating part 40 to partially remain in peripheral portions of the first coil pattern 22*a* and the second coil pattern 32*a*, including the through hole 41.

The thickness of the insulating part 40 that will remain may be determined in consideration of efficiency and inductance of the inductor, or be significantly decreased.

Figure 14:
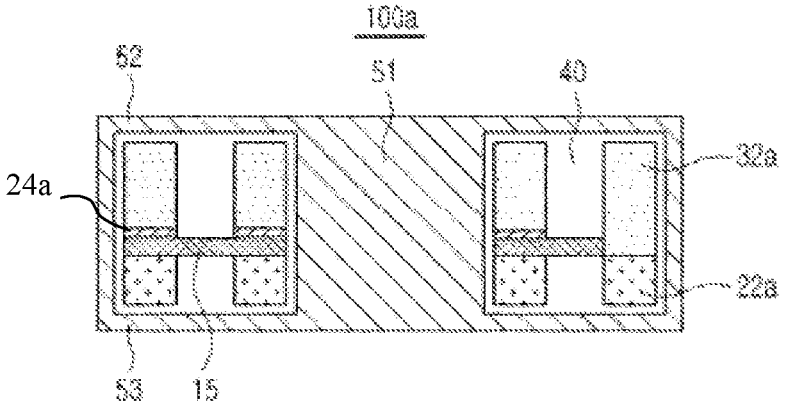

As illustrated in FIG. 14, a core 51 may be formed by filling the magnetic material in the through hole 41. Upper and lower cover parts 52 and 53 may be formed using the magnetic material.

The core 51 and the upper and lower cover parts 52 and 53 may be formed by stacking and compressing magnetic sheets.

Figure 15:
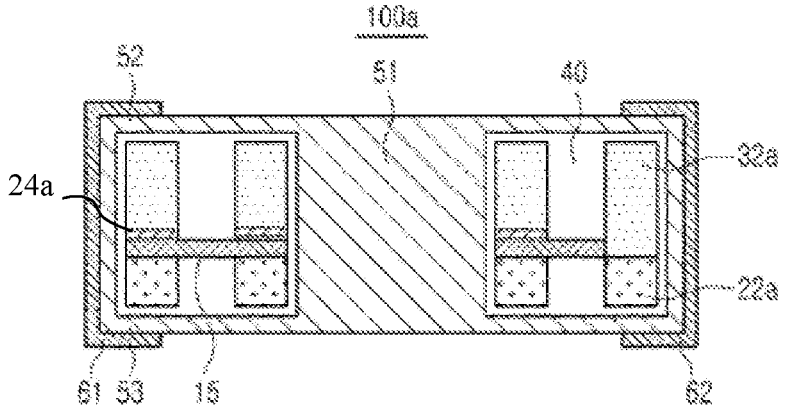

As illustrated in FIG. 15, first and second external electrodes 61 and 62 may be formed on external surface of the body.

The first and second external electrodes 61 and 62 may be electrically connected to end portions of the first coil pattern 22*a* and the second coil pattern 32*a*, respectively.

FIGS. 16 through 24 are cross-sectional views schematically illustrating a method of manufacturing a thin film inductor according to another exemplary embodiment in the present disclosure.

In the method of manufacturing a thin film inductor according to another exemplary embodiment in the present disclosure, since preparing a carrier film (S110) and forming a first layer (S120) are the same as those in the method of manufacturing a thin film inductor described above, so an overlapping description thereof is omitted.

After forming the first layer (S120), a second layer may be formed (S130). The second layer may be formed by forming a second layer 30*a*, including a second coil pattern 32*a*' and a second insulating pattern 31*a*', on a first layer 20*a* and forming a second layer 30*b*, including a second coil pattern 32*b*' and a second insulating pattern 31*b*', on a first layer 20*b*.

Figure 16:
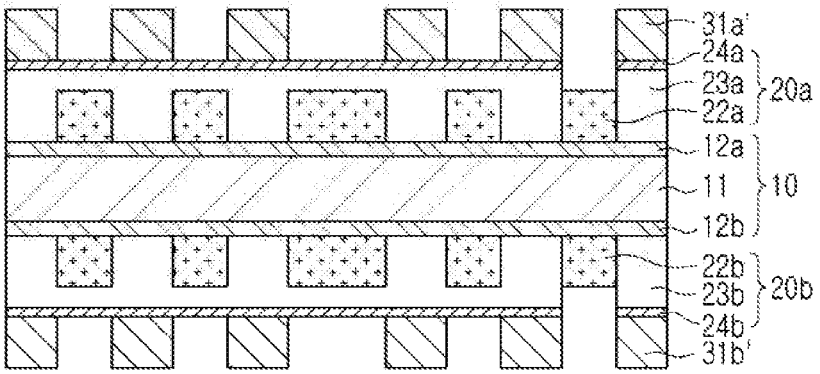
FIGS. 16 through 24 are cross-sectional views schematically illustrating a method of manufacturing a thin film inductor according to another exemplary embodiment in the present disclosure.
Figure 17:
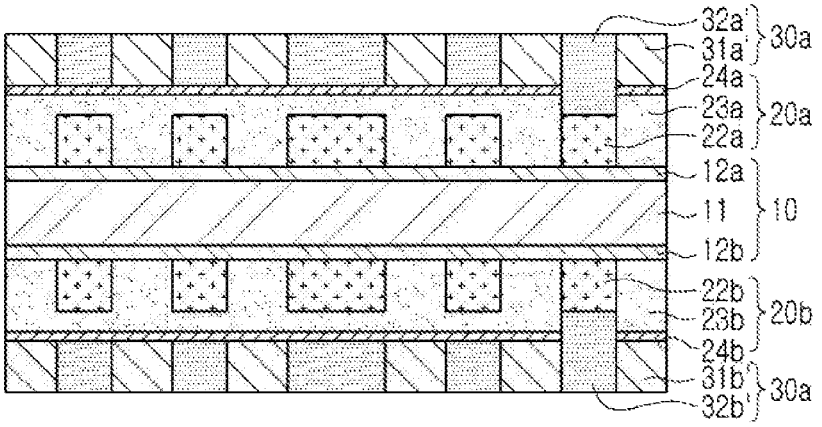

FIGS. 16 and 17 are views illustrating a process for forming the second layer (S130) according to another exemplary embodiment in the present disclosure using a photoresist.

Hereinafter, the forming of the second layer (S130) will be described in detail with reference to FIGS. 16 and 17.

Referring to FIG. 16, second insulating patterns 31*a*' and 31*b*' may be formed on the first insulating layers 23*a* and 23*b*, respectively (S131), and seed layers 24*a* and 24*b* may be exposed in a coil pattern shape by partially removing the second insulating patterns 31*a*' and 31*b*', respectively (S132).

The second insulating patterns 31*a*' and 31*b*' may be formed of the photoresist.

The photoresist used in the method of manufacturing a thin film inductor according to another exemplary embodiment in the present disclosure may be formed by applying a dry film resist (DFR) and exposing, developing, and drying the applied DFR. When using the dry film resist, there are advantages in that cost may be decreased compared to using an epoxy partition, and existing equipment and processes may be utilized.

Referring to FIG. 17, the second coil patterns 32*a*' and 32*b*' may be formed between the second insulating patterns 31*a* and 31*b*, respectively (S133).

The second coil patterns 32*a*' and 32*b*' may be formed (S133) using a plating method.

The second coil patterns 32*a*' and 32*b*' may be formed by plating copper (Cu) on the seed layers 24*a* and 24*b*.

After forming the second layer (S130), first and second bodies may be separated (S140). In separating the first and second bodies (S140), a first body 100*a* may be formed by separating the first layer 20*a* from the first separation layer 12*a* and a second body 100*b* may be formed by separating the first layer 20*b* from the first separation layer 12*b* (S141). The first separation layers 12*a* and 12*b* remaining on the first and second bodies 100*a* and 100*b* may be etched (S142).

Figure 18:
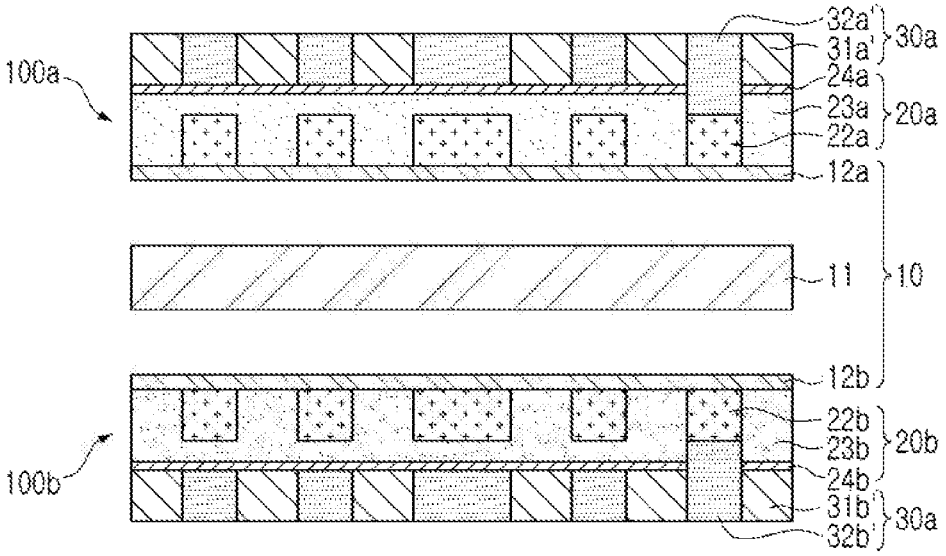
Figure 19:
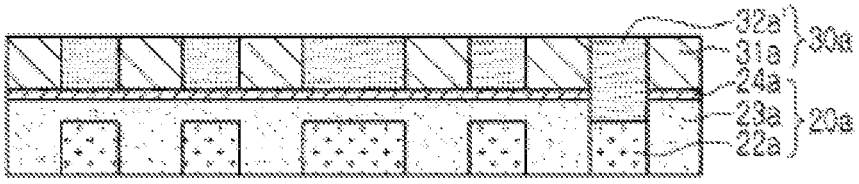

Referring to FIGS. 18 and 19, the first body 100*a* may be formed by separating the first layer 20*a* from the first separation layer 12*a* and the second body 100*b* may be formed by separating the first layer 20*b* from the first separation layer 12*b*.

The separation as described above may be performed using a detaching apparatus.

Since the first separation layers 12*a* and 12*b* may remain on the separated first and second bodies 100*a* and 100*b*, the remaining first separation layers 12*a* and 12*b* may be removed by etching.

Therefore, etched surfaces may be present on one surfaces of the first coil patterns 22*a* and 22*b*.

After separating the first and second bodies (S140), the finishing step (S150) may be performed.

The finishing step (S150) will be described in relation to the first body 100*a*, but is also applicable to the second body 100*b*.

The finishing step (S150) may include the following. In step s151, a portion of the first insulating layer 23*a* and the second insulating pattern 31*a*' may be removed. In step s152, an insulating part around the first coil pattern and the second coil pattern may be formed using a build-up film and a through hole may be formed in central portions of the first coil pattern and the second coil pattern. In step s153, upper and lower cover parts may be formed by compressing magnetic sheets on upper and lower portions of the first body, and external electrodes may be formed.

FIGS. 19 through 24 illustrate the finishing step (S150).

Hereinafter, the finishing step (S150) will be described in detail with reference to FIGS. 19 through 24.

FIG. 19 shows the first insulating layer 23*a*, the first seed layer 24*a*, and the second insulating pattern 31*a*' remaining in the separated body 100*a*.

Figure 20:
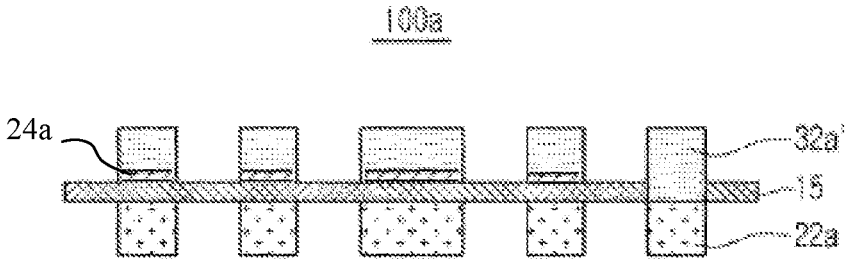

As illustrated in FIG. 20, except for a support member 15 as a portion of the first insulating layer 23*a* on a level between the seed layer 24*a* and the first coil pattern 22*a* and except for portions of the seed layer 24*a* on which the second coil pattern 32*a*' is formed, the remaining portions of the first insulating layer 23*a*, the first seed layer 24*a*, and the second insulating pattern 31*a*' may be removed using a $CO_2$ laser, or the like. Particularly, portions of the first seed layer 24*a* between the second insulating pattern 31*a*' and the first insulating layer 23*a* may be removed by etching.

The support member 15 may have a thickness of 40 μm or less.

Figure 21:
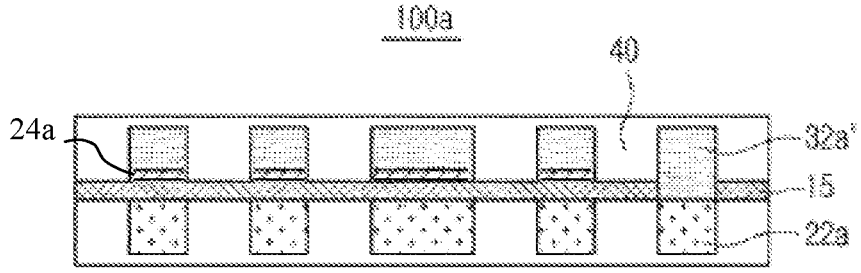

As illustrated in FIG. 21, an insulation part 40 may be formed to enclose the support member 15, the first coil pattern 22*a* disposed on a surface of the support member 15, and the second coil pattern 32*a*' disposed on the opposing surface of the support member 15.

According to the related art, an insulating part was formed by a chemical vapor deposition method (CVD) using phenylene. But in the method of manufacturing a thin film inductor according to another exemplary embodiment in the present disclosure, the insulating part 40 may be formed by vacuum-laminating a build-up film such as an Ajinomoto build-up film (ABF). When forming the insulating part 40 using the build-up film, close adhesion with a coil and close adhesion with the cover part formed of a magnetic material may be improved as compared to the CVD method using phenylene.

Figure 22:
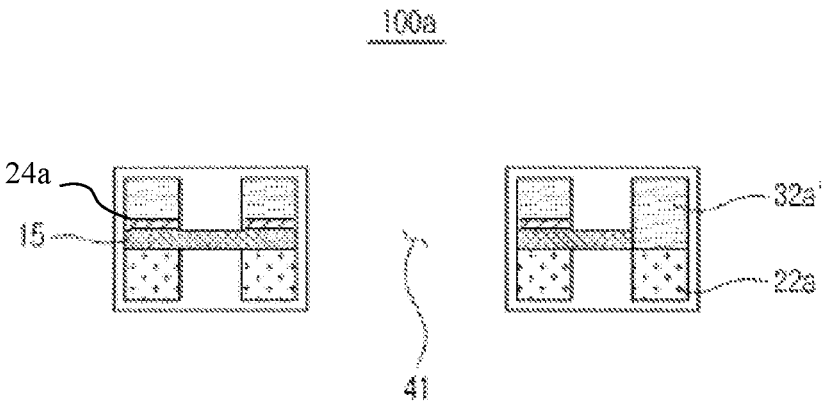
Figure 23:
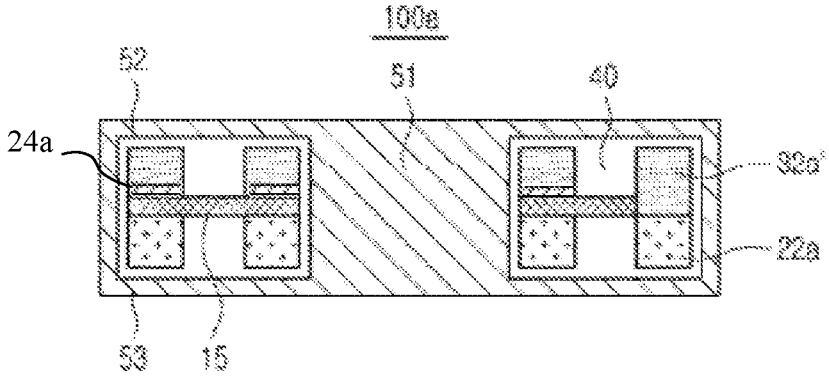
Figure 24:
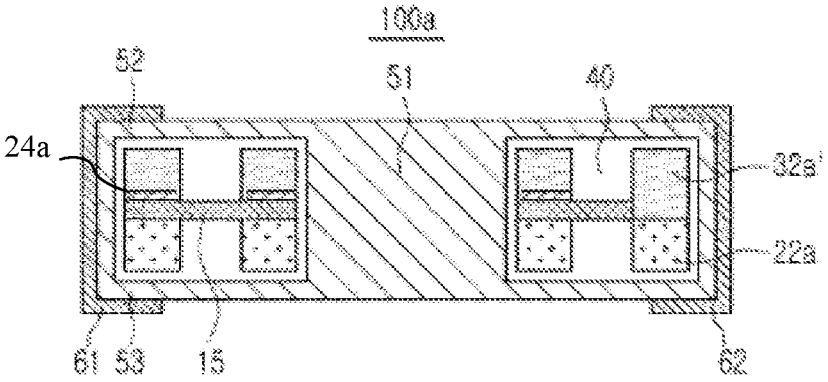

Referring to FIG. 22, after forming the insulating part 40, a through hole 41 may be formed in the central portions of the first coil pattern 22*a* and the second coil pattern 32*a*'. When forming the through hole 41, the insulating part 40 around the first coil pattern 22*a* and the second coil pattern 32*a*' may also be partially removed.

The through hole 41 may be formed using a $CO_2$ laser, or the like. Close adhesion with a core and a cover part, to be formed later using a magnetic material, may be improved by allowing the insulating part 40 to partially remain in peripheral portions of the first coil pattern 22*a* and the second coil pattern 32*a*', including the through hole 41.

The thickness of the insulating part 40 that will remain may be determined in consideration of efficiency and inductance of the inductor, or be significantly decreased.

As illustrated in FIG. 14, a core 51 may be formed by filling the magnetic material in the through hole 41. Upper and lower cover parts 52 and 53 may be formed using the magnetic material.

The core 51 and the upper and lower cover parts 52 and 53 may be formed by stacking and compressing magnetic sheets.

As illustrated in FIG. 15, first and second external electrodes 61 and 62 may be formed on external surface of the body.

The first and second external electrodes 61 and 62 may be electrically connected to end portions of the first coil pattern 22*a* and the second coil pattern 32*a*, respectively.

Thin Film Inductor

Figure 25:
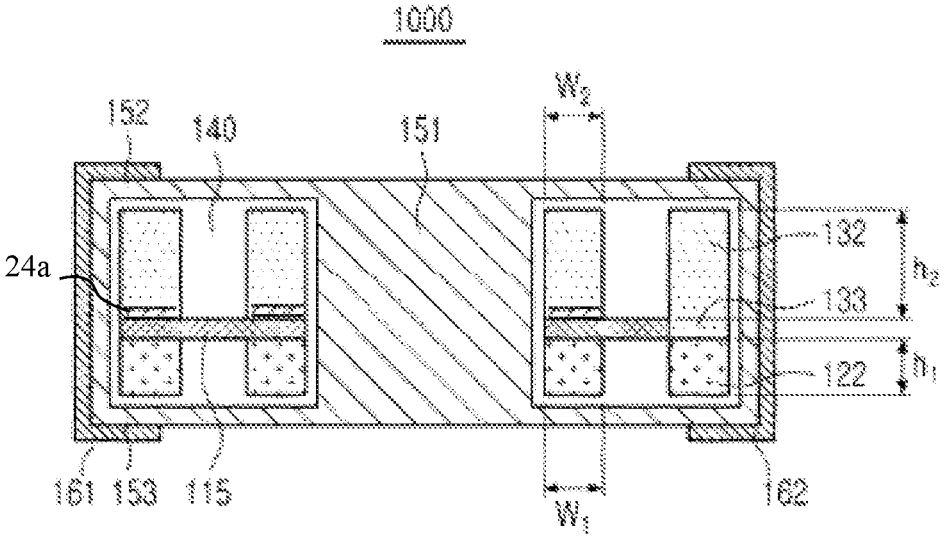
FIG. 25 is a cross-sectional view schematically illustrating a thin film inductor according to another exemplary embodiment in the present disclosure.

FIG. 25 is a cross-sectional view schematically illustrating a thin film inductor 1000 according to another exemplary embodiment in the present disclosure.

Referring to FIG. 25, the thin film inductor 1000 according to another exemplary embodiment may include an insulating part 140 including a support member 115 and having a central portion in which a core 151 formed of a magnetic material is disposed. First and second coil patterns 122 and 132 may be disposed in the insulating part 140 and may be electrically connected to each other by a via 133 penetrating through the support member 115, with the support member 115 interposed therebetween. Upper and lower cover parts 153 and 152 may be disposed on upper and lower portions of the insulating part 140 and may be formed of a magnetic material. The first coil pattern 122 may contain conductive particles and a binder, and the second coil pattern 132 may be a plating layer.

Since the first coil pattern 122 contains the conductive particles and the binder, the first insulating patterns 21*a* and 21*b* (see of FIG. 3) and the first coil pattern may have similar physical properties to each other.

Therefore, when lapping, the flatness of the inductor to be manufactured can be improved, and the thickness deviation of the inductor can be significantly decreased. In contrast, when the first coil pattern is a plating layer, since there is a large difference in physical properties between the first coil pattern and the first insulating patterns 21*a* and 22*b* (see FIG. 3), the thickness deviation may be increased after lapping.

Because the first coil pattern 122 contains conductive particles and a binder and the second coil pattern 132 is a plating layer, the time and cost to form the first coil pattern 122 may be decreased, and the second coil pattern 132 may be formed with a high aspect ratio using an epoxy partition. Since the insulating part 140 is formed using a build-up film instead of the CVD method using phenylene, the process time and cost may be decreased as compared to the CVD method using phenylene.

An overlapping description of configuration described in the method of manufacturing a thin film inductor described above is omitted.

The thickness of the support member 115 may be 40 μm or less.

Generally, in a thin film inductor, in order to solve problems such as bending of an element, or the like, during a manufacturing process, the support member is formed to have a thickness of 60 μm or more.

When using a coil having a high aspect ratio to improve performance of the thin film inductor, the limit on the height of the element may limit the ability to increase the height of the coil.

However, since the thin film inductor according to another exemplary embodiment in the present disclosure is manufactured using the carrier film, the thickness of the support member 115 may be 40 μm or less, and thus, magnetic properties of the thin film inductor may be improved by increasing the height of the coil despite the limited height of the element.

A lower limit value of the thickness of the support member 115 may be a value sufficient to maintain insulation properties. For example, when the thickness of the support member 115 is 5 μm or more, the insulation properties may be sufficiently maintained.

An aspect ratio ($h_2/w_2$) of the second coil pattern 132 may be 5 to 20. That is, a ratio between a height and a width of the second coil pattern 132 may be 5:1 to 20:1.

The thin film inductor 1000 according to another exemplary embodiment in the present disclosure may secure high inductance by having a second coil pattern 132 with an aspect ratio ($h_2/w_2$) of 5 or more.

The width $w_1$ of the first coil pattern 122 may be equal to the width $w_2$ of the second coil pattern 132, and the height $h_2$ of the second coil pattern 132 may be higher than a height $h_1$ of the first coil pattern 122.

As set forth above, the thin film inductor and the method of manufacturing the same according to exemplary embodiments in the present disclosure have an advantage in that the thin film inductor may have the support member having a thickness of 40 μm or less.

Further, the first layers may be formed on the first and second surfaces of the carrier film for manufacturing the thin film inductor according to the exemplary embodiment in the present disclosure, and one of the first insulating patterns may be formed to have a height greater than that of the first coil pattern on the same surface of the carrier film, such that at the time of performing a grinding work, quality may be improved.

While exemplary embodiments have been shown and described above, it will be apparent to those skilled in the art that modifications and variations could be made without departing from the scope of the present invention as defined by the appended claims.

What is claimed is:

1. A thin film inductor comprising:

an insulating part including a support member and having a central portion including a core formed of a magnetic material;

first and second coil patterns in the insulating part and electrically connected to each other by a via penetrating through an outer periphery of the support member, with the support member interposed therebetween;

a seed layer disposed between only portions of the second coil pattern and the support member, and spaced apart from the first coil pattern; and upper and lower cover parts formed of the magnetic material and disposed on upper and lower portions of the insulating part, respectively, wherein the first coil pattern contains conductive particles and a binder, and the second coil pattern and the via include a plating layer.

2. The thin film inductor of claim 1, wherein the support member has a thickness of 40 μm or less.

3. The thin film inductor of claim 1, wherein the second coil pattern has an aspect ratio of 5:1 or more.

4. The thin film inductor of claim 1, wherein the second coil pattern has a height greater than that of the first coil pattern.

5. The thin film inductor of claim 1, wherein the first and second coil patterns contain copper.

6. The thin film inductor of claim 1, wherein the via and the second coil pattern have a same width.

7. A thin film inductor comprising:

an insulating part including a support member having a thickness of 40 μm or less and having a central portion including a core formed of a magnetic material;

first and second coil patterns in the insulating part and electrically connected to each other by a via penetrating through an outer periphery of the support member, with the support member interposed therebetween;

a seed layer disposed between only portions of the second coil pattern and the support member, and spaced apart from the first coil pattern; and upper and lower cover parts formed of the magnetic material and disposed on upper and lower portions of the insulating part, respectively, wherein the first coil pattern contains conductive particles and a binder, and the second coil pattern includes a plating layer, and the first and second coil patterns and the support member are fully enclosed by the insulating part.

8. The thin film inductor of claim 7, wherein the second coil pattern has an aspect ratio of 5:1 or more.

9. The thin film inductor of claim 7, wherein the second coil pattern has a height greater than that of the first coil pattern.

10. The thin film inductor of claim 7, wherein the first and second coil patterns contain copper.

11. A thin film inductor comprising:

an insulating part including a support member and having a central portion including a core formed of a magnetic material;

first and second coil patterns in the insulating part and electrically connected to each other by a via penetrating through an outer periphery of the support member, with the support member interposed therebetween;

a seed layer disposed between only portions of the second coil pattern and the support member, and spaced apart from the first coil pattern; and upper and lower cover parts formed of the magnetic material and disposed on upper and lower portions of the insulating part, respectively, wherein the first coil pattern contains conductive particles and a binder, and the second coil pattern includes a plating layer, and the first and second coil patterns are made of different materials, and heights of the first and second patterns are different from each other.

12. The thin film inductor of claim 11, wherein the support member has a thickness of 40 μm or less.

13. The thin film inductor of claim 11, wherein the second coil pattern has an aspect ratio of 5:1 or more.

14. The thin film inductor of claim 11, wherein the second coil pattern has a height greater than that of the first coil pattern.

15. The thin film inductor of claim 11, wherein the first and second coil patterns contain copper.

* * * * *